United States Patent [19]

Borchardt et al.

[11] Patent Number: 4,778,282

[45] Date of Patent: Oct. 18, 1988

[54] TRIDENT INTERLOCKING CLOSURE PROFILE CONFIGURATION

[75] Inventors: Michael G. Borchardt, Woodridge, Ind.; Robert T. Dorsey; Ewald A. Kamp, both of Chicago, Ill.

[73] Assignee: First Brands Corporation, Danbury, Conn.

[21] Appl. No.: 94,904

[22] Filed: Sep. 10, 1987

Related U.S. Application Data

[62] Division of Ser. No. 774,997, Sep. 11, 1985, Pat. No. 4,710,968.

[51] Int. Cl.[4] ..... B65D 33/24

[52] U.S. Cl. ..... 383/63; 24/339; 24/399; 24/587; 156/66

[58] Field of Search ..... 383/63, 65; 24/339, 24/399, 400, 406, 576, 587, 30.5 R; 156/66, 244.15, 244.25; 428/100, 223, 99

[56] References Cited

U.S. PATENT DOCUMENTS

| | | | |
|---|---|---|---|
| 2,791,807 | 5/1957 | Morin | 156/244.25 X |
| 3,259,951 | 7/1966 | Zimmerman | 24/399 |
| 3,338,285 | 8/1967 | Jaster | 383/65 |
| 3,380,481 | 4/1968 | Kraus | 383/65 X |
| 4,428,788 | 1/1984 | Kamp | 156/66 |
| 4,516,268 | 5/1985 | Kamp | 383/63 |
| 4,561,108 | 12/1985 | Kamp | 383/63 |
| 4,578,813 | 3/1986 | Ausnit | 383/65 |
| 4,710,968 | 12/1987 | Borcherdt et al. | 383/63 |

FOREIGN PATENT DOCUMENTS

| | | | |
|---|---|---|---|
| 0552000 | 1/1958 | Canada | 24/399 |
| 1112446 | 8/1961 | Fed. Rep. of Germany | 383/63 |

*Primary Examiner*—Stephen Marcus
*Assistant Examiner*—Bryon Gehman
*Attorney, Agent, or Firm*—Gary L. Wamer

[57] ABSTRACT

An interlocking closure fastening device comprising an omega-shaped closure element and a co-acting closure element having a trident profile configuration. The co-acting closure element has a profile portion comprising three generally parallel arm portions. The first arm portion terminates in a hook portion, the second arm portion is a generally straight structure having at least one enlarged portion located anterior to its extremity, and the third arm portion terminates in a funnel portion. The closure device is adapted for use with reclosable plastic freezer storage and cooking bags to provide drip-proof and leak-proof seals.

2 Claims, 4 Drawing Sheets

FIG. 1
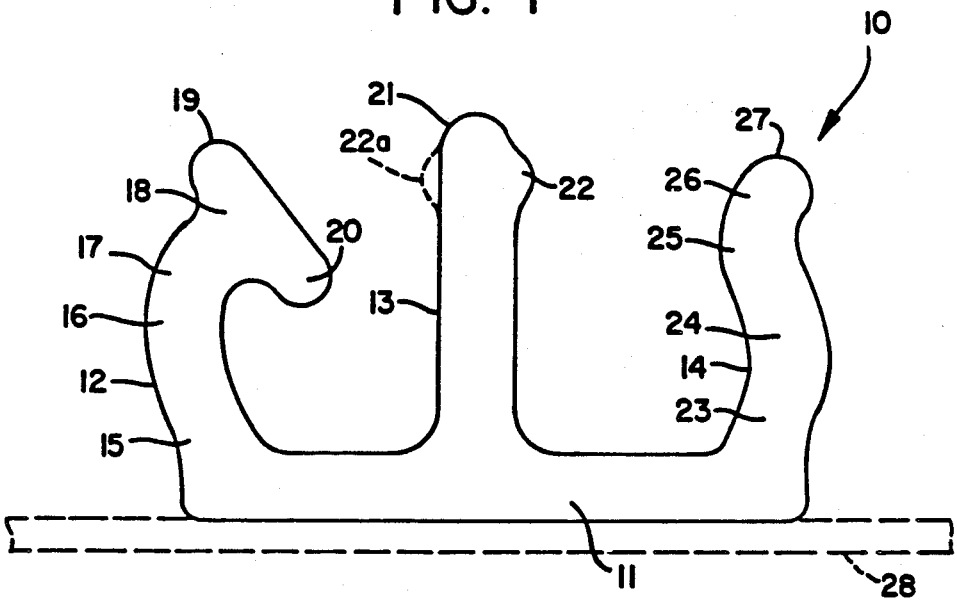
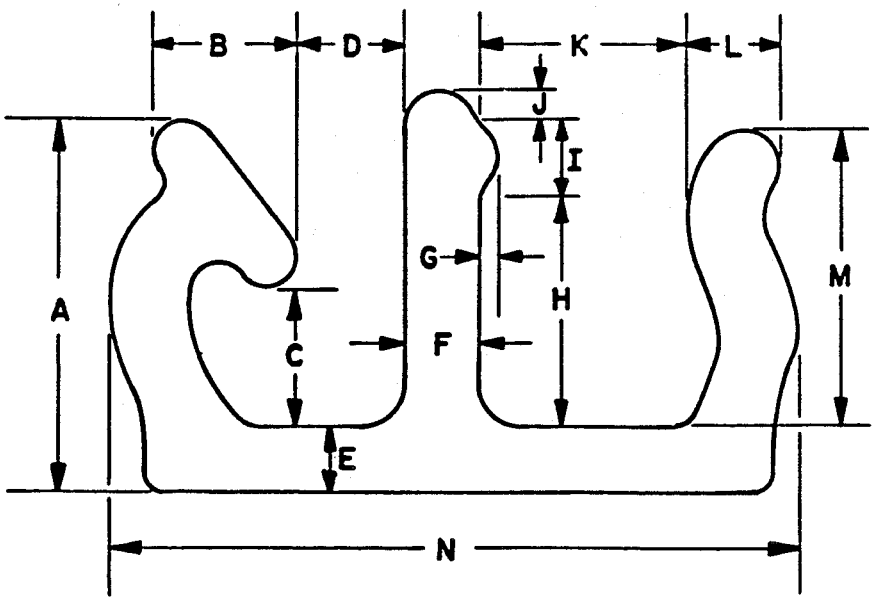
FIG. 2

FIG. 3
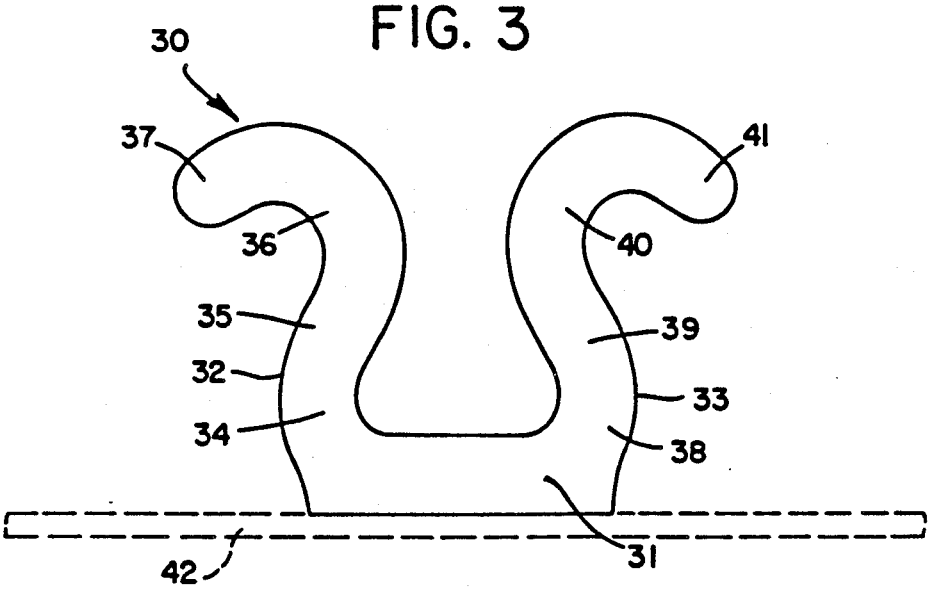
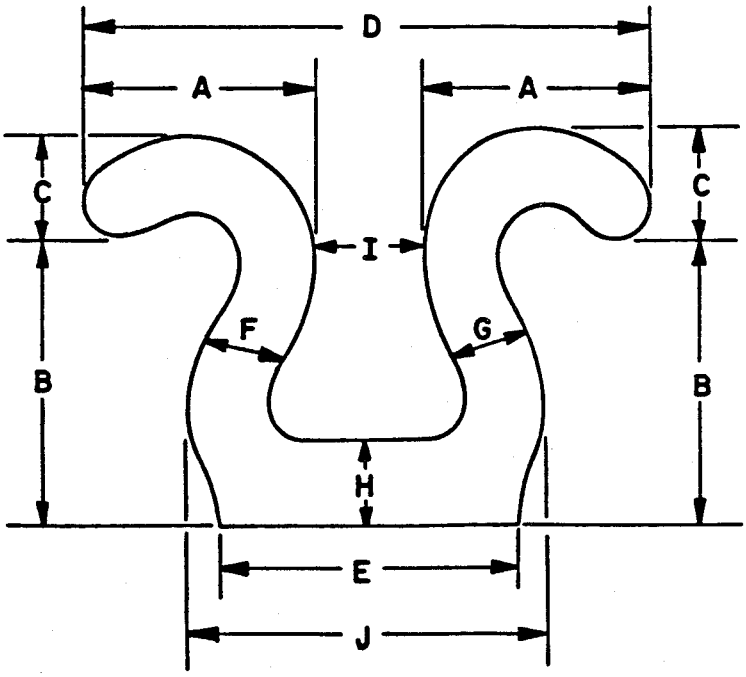
FIG. 4

TRIDENT INTERLOCKING CLOSURE PROFILE CONFIGURATION

This is a division of application Ser. No. 774,997, filed Sept. 11, 1985, now U.S. Pat. No. 4,710,968.

CROSS-REFERENCE TO RELATED APPLICATION

This application is related to copending application Ser. No. 774400 filed contemporaneously herewith, titled Single Hinge Interlocking Closure Profile Configuration, commonly assigned to the present assignee.

FIELD OF THE INVENTION

This invention relates to an interlocking closure fastening device, and more particularly, to an interlocking closure fastening device comprising an omega-shaped closure element and a co-acting closure element having a trident profile configuration. The closure device is particularly adapted for use with reclosable plastic storage bags.

BACKGROUND OF THE INVENTION

In general, closure fastening devices for use in connection with plastic bags and the like are known. Furthermore, manufacturing methods for closure fastening devices made of plastic material are generally well known.

In operation, a closure fastening device for use in connection with a flexible container should be relatively easy to open from the outside, but relatively difficult to open from the inside. Generally, such a container can be used with its interior either under relatively high pressure or under relatively low pressure. The interior of a container is considered to be under relatively high pressure where the container is filled to its capacity, and under relatively low pressure when the container is only partially filled. The closure fastening device should provide a satisfactory seal for either condition, that is, the seal should be drip-proof and leak-proof.

Preferably, the closure fastening device should be suitable for economical manufacturing and should be relatively simple in design. In addition, to design should provide for variations in order to meet different needs. For example, it may be desirable to have a closure fastening device which is relatively more difficult to open from the inside than from the outside. In general, the closure fastening device, however, should always be relatively easy to close.

In addition, when the closure fastening device is employed with a container, the container may be made from a thermoplastic material and the closure device and sidewalls of the container can be made integrally by extrusion as a unitary piece or can be made as separate components which are subsequently permanently connected together.

One of the latest developments of such containers is a bag which can be used as a food storage container in a refrigerated or frozen condition as well as for heating and/or cooking food such as by placing the bag in hot water or in a microwave open. When used in a microwave oven, it is not unusual for such bags to encounter temperatures of 260° F. to 300° F., for example, such as when cooking meats. Even during the boiling of foods, such as in a metal pot, temperatures higher than 212° F. are sometimes obtained above the water level such as near the rim of the pot necessitating better temperature resistance to softening or melting of the plastic bag than can be provided by the frequently used polyethylene resins. In order to overcome such problems at elevated temperatures, it is known that higher melting point resins may be employed which have higher stiffness moduli and therefore resist softening or melting. However, when such higher stiffness moduli resins are employed as the materials of construction for the closure device, the closure device resists bending and deflection, which are the most frequently used means of occlusion and de-occlusion of interlocking closure devices made from flexible resins such as polyethylene.

Another requirement of plastic food containers is the provision of an interlocking closure device which is drip-proof and leak-proof even when made from thermoplastic materials having the aforementioned properties of high stiffness moduli and resistance to elevated temperatures. Copending application Ser. No. 774400 filed contemporaneously herewith, titled Single Hinge Interlocking Closure Profile Configuration, commonly assigned to the present assignee, describes an interlocking closure device which meets the aforementioned temperature criteria and has the advantage of ease of occlusion and de-occlusion from outside forces while strongly resisting inside opening forces. However, this closure device is dripless when the container is filled with liquids only when the closure device is very carefully extruded. Accordingly, the direct and associated costs of manufacturing the single hinge type of interlocking closure device are quite high.

Therefore, it would be highly desirable to obtain an interlocking closure device having relative ease of occlusion and de-occlusion, wherein the interlocking closure device is resistant to elevated temperatures, the closure device may be manufactured with ample tolerance latitude, and wherein a container equipped with the interlocking closure device is leak-proof and drip-proof at the various temperatures and conditions of use.

SUMMARY OF THE INVENTION

The foregoing criteria for an interlocking closure fastening device and a container equipped with said device are provided in accordance with the present invention wherein the fastening device comprises a first closure element having a general omega shape comprising an apex portion, and a profile portion extending from the apex portion, said apex portion being generally straight or slightly arcuate, and said profile portion comprising two spaced apart inwardly curved arm portions terminating in two outwardly facing, curvilinear hook portions. The closure device includes a second closure element having a general trident shape comprising a generally straight or slightly arcuate apex portion, and a profile portion extending in a generally perpendicular direction from the apex portion. The profile portion of the second closure element comprises first, second, and third, spaced apart generally parallel arm portions. The first arm portion of the second closure element has a base portion which initially curves generally outwardly, a middle portion which curves generally inwardly, and a top portion which curves generally inwardly forming a hook portion, and then terminates in an outwardly extending hook projection portion and an inwardly extending hook projection portion which is larger than the outwardly extending hook projection portion. The hook projection portions of the first arm portion of the second closure element having a generally rounded configuration. The second arm portion of the second closure element is positioned generally equidistant between the first arm portion and the third arm portion of the second closure element, and comprises a generally straight structure extending perpendicularly from the apex portion of the second closure element, and has a generally rounded configuration at its extremity, and at least one enlarged portion located anterior of the extremity of the second arm portion. The third arm portion of the second closure element has a base portion which curves generally outwardly, a middle portion which curves generally inwardly, and a top portion which curves generally outwardly that preforms a funnel action to guide the first closure element during occlusion with said second closure element. The extremity of the third arm portion has a generally rounded configuration. The first closure element and the second closure element form an interlocked closure fastening device when they are occluded together. By omega shape is meant having a shape as the last letter of the Greek alphabet, and by trident shape is meant having a shape such as a 3-pronged spear or having 3 points.

The afore-described first closure element and the second closure element are adapted to engage and disengage each other by means of a twisting or rotating action so as to form a straddling type of occlusion wherein the first arm portion and the third arm portion of the second closure element are positioned on the exterior side of the arm portions of the first closure element, and the second arm portion of the second closure element is positioned between the arm portions of the first closure element.

BRIEF DESCRIPTION OF THE DRAWINGS

FIG. 1 is a cross-sectional view of one embodiment of the second closure element of the closure fastening device in accordance with this invention;

FIG. 2 is a cross-sectional view of the second closure element shown in FIG. 1 to illustrate typical physical dimensions;

FIG. 3 is a cross-sectional view of one embodiment of the first closure element of the closure fastening device in accordance with this invention;

FIG. 4 is a cross-sectional view of the first closure element shown in FIG. 3 to illustrate typical physical dimensions;

DETAILED DESCRIPTION OF THE PREFERRED EMBODIMENTS

Figure 5:
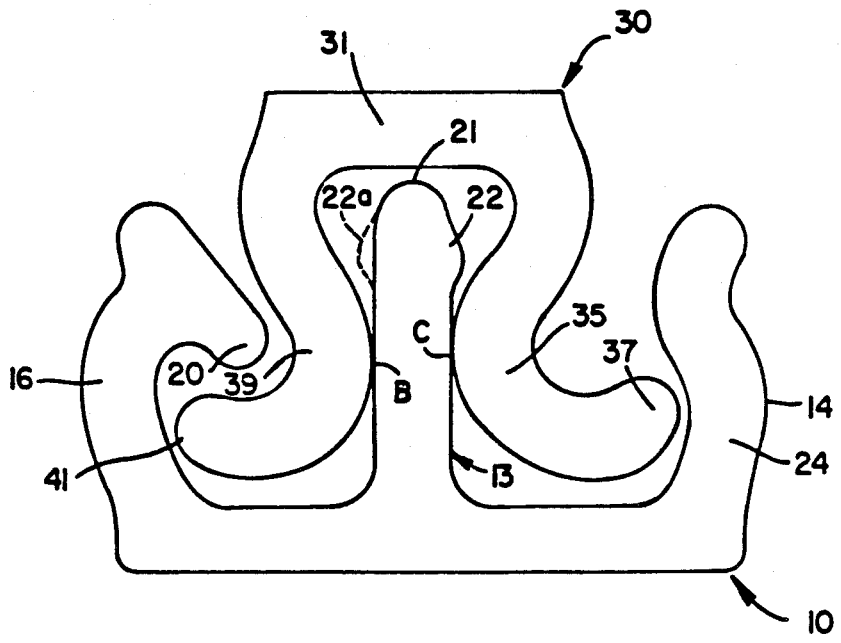
FIG. 5 is a cross-sectional view of the second closure element shown in FIG. 1 and the first closure element shown in FIG. 3 in a relaxed occluded position, i.e., under relatively low pressure.

For a fuller understanding of the nature of the invention, reference should be made to the following detailed description, taken in conjunction with the accompanying drawings.

FIG. 1 is a cross-sectional view of one embodiment of the second closure element of the closure fastening device in accordance with this invention. As shown in FIG. 1, second closure element 10 has a general trident shape, and comprises an apex portion 11 which may have a generally straight line or slightly arcuate configuration. Extending from apex portion 11 in a generally perpendicular direction therefrom is a profile portion comprising a first generally parallel arm portion 12, a second generally parallel arm portion 13, and a third generally parallel arm portion 14.

First arm portion 12, second arm portion 13, and third arm portion 14 are generally parallel to and spaced apart from each other.

First arm portion 12 of closure element 10 has a base portion 15 which initially curves generally outwardly, a middle portion 16 which curves generally inwardly, and a top portion 17 which curves generally inwardly forming a hook portion 18 and then terminates in an outwardly extending hook projection portion 19 that performs a funnel action to guide the first closure element during occlusion with the second closure element. Hook portion 18 also has an inwardly extending hook projection portion 20 which is larger in size than outwardly extending hook projection portion 19.

Second arm portion 13 of second closure element 10 comprises a generally straight structure extending from apex portion 11 in a perpendicular direction thereform, and which structure is slightly longer than first arm portion 12 and third arm portion 14. Second arm portion 13 has a generally rounded configuration at its extremity 21, and has at least one enlarged portion 22 located anterior of the extremity of the second arm portion. A second enlarged portion 22*a*, shown in ditted line, may optionally be located anterior of the extremity of the second arm portion on the other side of the second arm portion.

Third arm portion 14 of closure element 10 has a base portion 20 which initially curves generally outwardly, a middle portion 24 which curves generally inwardly, and a top portion 25 which curves generally outwardly prior to terminating in an outwardly extending funnel portion 26. Funnel portion 26 terminates in extremity 27 having a generally rounded configuration. Optionally, but preferably, closure element 10 is also provided with flange portions 28 shown in dotted lines for attachment of closure element 10 to the sidewall of a bag or container.

FIG. 2 is a cross-sectional view of the second closure element shown in FIG. 1 to illustrate typical physical dimensions thereof wherein:

1. A may be from about 0.040 to about 0.100 inch, preferably about 0.065 inch;
2. B may be from about 0.010 to about 0.025 inch, preferably about 0.019 inch;
3. C may be from about 0.020 to about 0.040 inch, preferably about 0.028 inch;
4. D may be from about 0.020 to about 0.040 inch, preferably about 0.026 inch;
5. E may be from about 0.007 to about 0.015 inch, preferably about 0.012 inch;
6. F may be from about 0.007 to about 0.015 inch, preferably about 0.012 inch;
7. G may be from about 0.001 to about 0.005 inch, preferably about 0.002 inch;
8. H may be from about 0.030 to about 0.060 inch, preferably about 0.040 inch;
9. I may be from about 0.005 to about 0.012 inch, preferably about 0.008 inch;
10. J may be from about 0.002 to about 0.010 inch, preferably about 0.004 inch;
11. K may be from about 0.020 to about 0.050 inch, preferably about 0.038 inch;

12. L may be from about 0.007 to about 0.015 inch, preferably about 0.012 inch;
13. M may be from about 0.030 to about 0.090 inch, preferably about 0.050 inch; and
14. N may be from about 0.070 to about 0.180 inch, preferably about 0.125 inch.

As shown in FIG. 2,

A represents the length dimension of the first arm portion of the second closure element as measured from the outside surface of the apex portion to the top of its hook projection portion.

B represents the maximum width dimension of hook projection portion 19 and hook projection portion 20 of the first arm portion shown in FIG. 1.

C represents the length dimension between hook projection portion 20 and the inside surface of the apex portion of the first arm portion.

D represents the distance between hook projection portion 20 of the first arm portion 10 the second arm portion.

E represents the height of the apex portion of the first arm portion.

F represents the thickness of the second arm portion.

G represents the width of enlarged portion 22 of the second arm portion.

H represents the distance between enlarged portion 22 of the second arm portion and the inside surface of the apex portion of the second arm portion.

I represents the height of enlarged portion 22 of the second arm portion.

J represents the height of rounded extremity 21 of the second arm portion.

K represents the distance between the second arm portion and curved top portion 25 of the third arm portion.

L represents the width of top portion 25 and extremity 27 of the third arm portion.

M represents the length dimension of the third arm portion of the second closure element as measured from the outside surface of the apex portion to the top of extremity 27.

N represents the width dimension of the second closure element as measured from the widest part of the first arm portion to the widest part of the third arm portion of the second closure element.

FIG. 3 is a cross-sectional view of one embodiment of the first closure element of the closure fastening device in accordance with this invention. As shown in FIG. 3, first closure element 30 has a general omega shape, and comprises an apex portion 31 which may have a generally straight line or slightly arcuate configuration. Extending from apex portion 31 in a generally perpendicular direction therefrom is a profile portion comprising a first arm portion 32 and a second arm portion 33. As shown in FIG. 3, first arm portion 32 and second arm portion 33 are spaced apart from each other. First arm portion 32 of closure element 30 has a base portion 34 which initially curves generally outwardly, a middle portion 35 which curves generally inwardly, and a top portion 36 which curves generally outwardly before terminating in an outwardly, laterally extending, curvilinear hook portion 37.

Second arm portion 33 of closure element 30 has a base portion 38 which initially curves generally outwardly, a middle portion 39 which curves generally inwardly, and a top portion 40 which curves generally outwardly before terminating in an outwardly, laterally extending, curvilinear hook portion 41. Optionally, but preferably, closure element 30 is also provided with flange portions 42 shown in dotted lines for attachment of closure element 30 to the sidewall of a bag or container.

FIG. 4 is a cross-sectional view of the first closure element shown in FIG. 3 to illustrate typical physical dimensions thereof wherein:

1. A may be from about 0.020 to about 0.060 inch, preferably about 0.040 inch;
2. B may be from about 0.040 to about 0.080 inch, preferably about 0.058 inch;
3. C may be from about 0.010 to about 0.030 inch, preferably about 0.020 inch;
4. D may be from about 0.060 to about 0.110 inch, preferably about 0.095 inch;
5. E may be from about 0.040 to about 0.090 inch, preferably about 0.060 inch;
6. F may be from about 0.007 to about 0.020 inch, preferably about 0.014 inch;
7. G may be from about 0.007 to about 0.020 inch, preferably about 0.014 inch;
8. H may be from about 0.007 to about 0.025 inch, preferably about 0.017 inch;
9 I is defined in terms of dimension F on FIG. 1 so a leak-proof seal can be formed. I may be from about F+0.001 inch to about F−0.006 inch, preferably F−0.003 inch; and
10. J may be from about 0.040 to about 0.090 inch, preferably about 0.065 inch.

As shown in FIG. 4,

A represents the length dimension of top portion 36 and curving hook portion 37 of first closure element 30, and also represents the length dimension of top portion 40 and curving hook portion 41 of first closure element 30.

B represents the height dimension between curving hook portion 37 and the outside surface of apex portion 31 of first closure element 30, and also represents the height dimension between curving hook portion 41 and the outside surface of apex portion 31 of first closure element 30.

C represents the maximum width dimension between the uppermost curved sections and the lowermost curved sections of hook portions 37 and 41.

D represents the overall width dimension of the first closure element as measured from the widest part of hook portions 37 and 41.

E represents the maximum width dimension of apex portion 31 at its surface.

F represents the width dimension of arm portion 32.

G represents the width dimension of arm portion 33.

H represents the height of apex portion 31 of the first closure element.

I represents the minimum distance between middle portion 35 of first arm portion 32 and middle portion 39 of second arm portion 33.

J represents the width dimension between the widest parts of base portion 34 and base portion 38 of the first closure element.

FIG. 5 is a cross-sectional view of the second closure element shown in FIG. 1 and the first closure element shown in FIG. 3 in a relaxed, occluded position. As shown in FIG. 5, when the closure fastening device of this invention is in a relaxed, occluded position such as when a container is only partially filled with contents, e.g., food, middle arm portion 39 of closure element 30 is in contact with second arm portion 13 and enlarged portion **22*a* of closure element 10 (contact point B), and middle arm portion 35 of closure element 30 is in contact with second arm portion 13 and enlarged portion 22 of closure element 10 (contact point C). When in a relaxed, occluded position, the closure fastening device of this invention forms a leak-proof seal at two contact points, i.e., contact points B and C, as illustrated in FIG. 5**.

Figure 6:
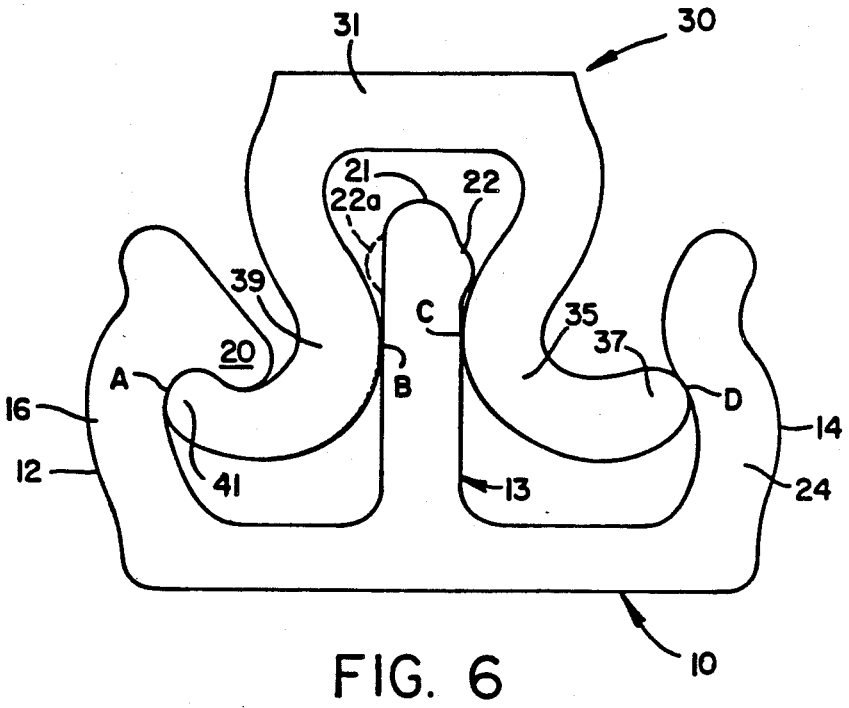
FIG. 6 is a cross-sectional view of the second closure element shown in FIG. 1 and the first closure element shown in FIG. 5 in an occluded position under relatively high pressure.

In addition, as shown i.e., FIG. 6, when the closure fastening device of this invention is in an occluded position under pressure such as when a container is filled with contents, hook portion 41, of closure element 30 is in contact with middle arm portion 16 of closure element 10 (contact point A), middle arm portion 39 of closure element 30 is in contact with second arm portion 13 of closure element 10, and enlarged portion 22*a* of second arm portion 13 (contact point B), middle arm portion 35 of closure element 30 is in contact with second arm portion 13 and enlarged portion 22 (contact point C), and hook portion 37 of closure element 30 is in contact with middle arm portion 24 of closure element 10 (contact point D). When occluded and under pressure, the closure fastening device of this invention forms a leak-proof seal at four contact points, i.e., contact points A, B, C and D, as illustrated in FIG. 6.

It has been found that during occlusion and de-occlusion of the closure fastening device of this invention, one or both of the closure elements of the fastening device experience a gradual twisting or rotating operation spread over a significant length of the closure on either side of the point of initial force application. The spreading action of this rotation reduces stress levels, thereby reducing force. During de-occlusion of the fastening device, this twisting or rotating operation continues until the hook portions of the closure elements have disengaged from each other. Typically, by reference to FIG. 6, it may be seen that for de-occlusion of the closure fastening device, an external release force is exerted on arm portion 24 and hook portion 37 of the closure elements, and on hook portion 39 and arm portion 13 of the closure elements to cause release of hook portions 37 and 39 from arm portion 24 and arm portion 13 of the closure elements. The afore-mentioned parts of the fastening device are rotated over an arc of about 35 degrees. In order to obtain full release of the closure elements and de-occlusion of the fastening device, rotation of the closure elements is continued over an arc of between about 100° and 120°. During the continued rotation, hook portions 37 and 39 disengage from arm portion 24 and arm portion 13, while rotating around hook projection portion 20 of arm portion 12 until the parts are separated from each other.

It can also be seen from FIG. 6 that hook portion 41 is adapted to engage in a hinging contact with hook projection portion 20, and hook portion 37 is adapted to engage in a clamping contact with arm portion 14. Further, closure element 10 and closure element 30 form a straddling occlusion with arm portion 13, and an overlapping occlusion with arm portion 12 and arm portion 14, respectively. A straddling type of occlusion occurs when the first arm portion and the third arm portion of the second closure element are positioned on the exterior side of, but in contact with, the first closure element, and when the second arm portion of the second closure element is positioned between both of the arm portions of the first closure element. An overlapping occlusion occurs when the first arm portion of the first closure element is positioned between the first arm portion and the second arm portion of the second closure element, and the second arm portion of the first closure element is positioned between the second arm portion and the third arm portion of the second closure element. When the closure fastening device is connected to a plastic container, arm portion 14 and hook portion 37 are positioned closest to the mouth or outside portion of the container, and arm portion 12 is positioned closest to the interior or inside portion of the container. When occluded, the closure fastening device forms an easily disengageable structure from the outside portion of the container, while forming a structure which is strongly resistant to de-occlusion from the inside portion of the container, and one which is leak-proof when the container has contents therein. Thus, the closure fastening device of this invention provides a container which is leak-proof when the container is partially filled and the closure device is not under pressure as to force the closure elements into contact with each other, and the container is also leak-proof when the container is completely filled and the closure device is under pressure.

The preferred closure fastening device of this invention as illustrated in FIG. 5 was evaluated for opening loads for comparison with a commercial plastic container product having a closure fastening device. In all the evaluations, each occluded closure fastening device was cut into a six-inch long sample. The closure fastening device samples are tested by attaching a piece of one inch wide scotch tape doubled over to grip the inside and/or outside flange portions of the fastening device. Each sample was tested independently as described herein. The first closure element of the closure fastening device was mounted in the upper jaw, and the second closure element of the closure fastening device was mounted in the lower jaw, of an Instron ® tensile tester. The force required to de-occlude the closure fastening device was recorded on a strip chart recorder as the maximum force registered. The average value was listed as the average of five test specimens and it was recorded as release force. The jaw separation (de-occlusion) rate was 20 inches per minute and the full scale load was 20 pounds. Each of 5 identical samples was re-occluded and re-tested for a total of 5 tests. The value reported was thus the average of 25 tests for each sample.

The Instron instrument was a tensile tester Model No. 1130, using a "B" load cell with a zero to 20-pound range. The Instron tester is initially calibrated in the following manner. The pen and chart recorder are turned on. The zero button is pressed and held, and the zero adjust knob is positioned for a 0.00 reading on the recorder. The zero button is then released. The range switch is then turned to the setting of 1 on its 1, 2, 5, 10, 20 scale. The coarse balance control is turned so that if the pen is all the way over to the left, it starts coming towards zero on the right. The coarse balance control is left at this position. Then the fine balance control is turned so that the pen is at a setting of 0.00. A 20-pound weight is placed in the upper jaw of the Instron instrument and the calibration control is adjusted for a full-scale recorder reading. After removing the weight, the recorder should again read 0.00. The zero button is pressed and held, and the recorder should again read 0.00.

Sample 1 represents a closure fastening device employed with a container available from Dow Chemical Company, Midland, Mich., under the tradename ZIPLOC ® Microfreeze, and is believed to be made from low density polyethylene having a melting point of about 220° F.

Sample 2 represents a closure fastening device in accordance with the invention and as illustrated in FIG. 5. This closure device had the aforementioned preferred dimensional values given with respect to FIG. 2 and FIG. 4. The closure fastening device was made from a poly(propylene-ethylene)copolymer having a melting point of about 313° F., and which is commercially available from Himont, Inc., Wilmington, DE, under the tradename Pro-Fax® SA-861. The flange portions connecting the closure fastening device to the sidewalls of the container were made from about 90 weight percent of a polypropylene homopolymer which is available from Shell Chemical Company under the designation Shell Polypropylene 5225, and about 10 weight percent of poly-1-butene copolymer containing up to about 5 percent by weight of ethylene which is commercially available from Shell Chemical Company under the designation Shell Polybutylene 8640.

Both outside opening forces and inside opening forces were recorded. By outside opening forces is meant the forces required to de-occlude the closure fastening device from the outside portion of a container. By inside opening forces is meant the forces required to de-occlude the closure fastening device from the inside portion of a container.

In addition, peel force is a measure of the force required to pull the two closure elements apart once the initial opening has been started. A high peel force is desirable because it enables opening the bag only a small amount. This small opening can act as a vent to either squeeze the air out of the container before freezing, or to let pressure out of the container during cooking. The peel force is measured by placing a partially opened closure device in the jaws of the afore-described Instron tensile tester with the first closure element in one jaw and the second closure element in the other jaw. The Instron tester pulls the two closure elements apart and measures the force required to peel the closure elements apart in units of grams.

A liquid leakage test was also conducted on the containers of the aforedescribed sample 1 and sample 2. One quart of water which had been stained with dark food coloring was poured into each bag. The closures were sealed and the bags were placed on their side on top of a white napkin (or other white absorbent substance). The bags still have a small air pocket inside of them when they are placed on their side. Any water that leaks from a bag can be easily identified by the spots of color that will form on the white napkin. After the bags are placed on their side, the bags and closures are inspected immediately for leakage. These inspections are repeated every fifteen minutes for the first hour and every hour for the next 6 hours. The location of the leak in a bag can be determined from the location of the colored spots on the napkin.

The test results are given below in Table 1.

TABLE 1

| Sample | Opening Force (lbs.) Outside | Opening Force (lbs.) Inside | Peel Force (Grams) | Leakage Through Closure Device |
|---|---|---|---|---|
| 1 | 1.7 | 3.9 | 34 | slight |
| 2 | 1.8 | 5.5 | 77 | none |

From the data in Table 1, it can be seen that the container having the closure fastening device of this invention, i.e., the container of sample 2, is leak-proof in that no leakage was found therefrom in the leakage test. By the same token, the container of sample 1, i.e., the commercial Microfreeze container, was not leak-proof in that slight leakage through the closure fastening device was found. Further, it can be seen from the data in Table 1 that the closure fastening device of the container of sample 2 has a superior peel force compared to the peel force of the closure fastening device of the container of sample 1. In addition, the container of sample 2 is just as easy to open from the outside as is that of sample 1 even though the closure device of sample 2 is made from polypropylene and the closure device of sample 1 is made from low density polyethylene having a low flexural modulus. The closure device of sample 2 is also more resistant to opening from the inside of the container than that of sample 1.

Figure 7:
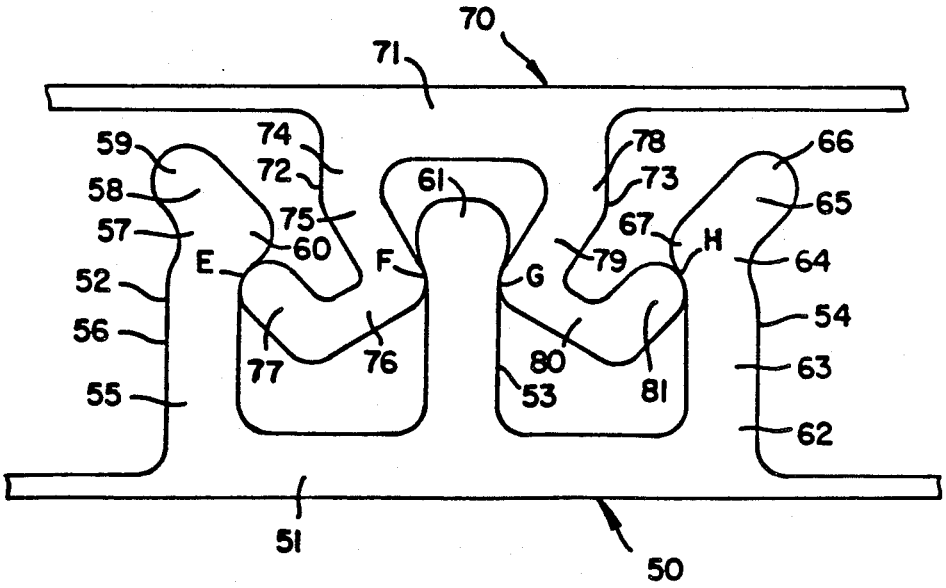
FIG. 7 is a cross-sectional view of an alternative embodiment of the closure fastening device of this invention in an occluded position under relatively high pressure.

An alternative embodiment of the closure fastening device of this invention is illustrated in FIG. 7. As shown in FIG. 7, second closure element 50 has a general trident shape, and comprises an apex portion 51 which may have a generally straight line or slightly arcuate configuration. Extending from apex portion 51 in a generally perpendicular direction therefrom is a profile portion comprising a first arm portion 52, a second arm portion 53, and a third arm portion 54. First arm portion 52, second arm portion 53, and third arm portion 54 are generally parallel to and spaced apart from each other.

First arm portion 52 of closure element 50 has a base portion 55 which extends perpendicularly from apex portion 51 in a generally straight line. First arm portion 52 has a generally straight middle portion 56 which extends from base portion 55 to a top portion 57 that includes a hook portion 58. Hook portion 58 terminates in an outwardly extending hook projection portion 59 that performs a funnel action to guide the first closure element during occlusion with the second closure element. Hook portion 58 also has an inwardly extending hook projection portion 60 which is smaller in size than outwardly extending hook projection portion 59.

Second arm portion 53 of second closure element 50 comprises a generally straight structure extending from apex portion 51 in a perpendicular direction therefrom, wherein said arm portion 53 is shorter than first arm portion 52 and third arm portion 54. Second arm portion 53 has a generally rounded, enlarged configuration at its extremity 61.

Third arm portion 54 of closure element 50 has a base portion 63 which extends perpendicularly from apex portion 51 in a generally straight line. Third arm portion 54 has a generally straight middle portion 63 which extends from base portion 62 to a top portion 64 that includes a hook portion 65. Hook portion 65 terminates in an outwardly extending hook projection portion 66 that performs a funnel action to guide the first closure element during occlusion with the second closure element. Hook portion 65 also has an inwardly extending hook projection 67 which is smaller in size than outwardly extending hook projection portion 66.

Also shown in FIG. 7 is first closure element 70 of the alternative embodiment of the closure fastening device of this invention. In FIG. 7, first closure element 70 has a general omega shape, and comprises an apex portion 71 and a profile portion extending from the apex portion. Apex portion 71 may have a generally straight line or slightly arcuate configuration. Extending from apex portion 71 in a generally perpendicular direction therefrom is a profile portion comprising a first arm portion 72 and a second arm portion 73 spaced apart from each other. First arm portion 72 of closure element 70 has a base portion 74 which extends from apex portion 71 in a generally perpendicular direction therefrom, a middle portion 75 which extends generally laterally inwardly, and a top portion 76 which extends generally laterally outwardly before terminating in an outwardly, laterally extending, curving hook portion 77.

Second arm portion 73 of closure element 70 has a base portion 78 which extends from apex portion 71 in a generally perpendicular direction therefrom, a middle portion 79 which extends generally laterally inwardly, and a top portion 80 which extends generally laterally outwardly before terminating in an outwardly, laterally extending, curving hook portion 81. As in the preferred embodiment, the instant alternative embodiment of the closure fastening device of this invention is drip-proof and leak-proof, and may be provided with flange portions as shown in FIG. 1 at element 28, and FIG. 3 at element 42. It can also be seen from FIG. 7 that closure element 70 when in an occluded position under relatively high pressure as shown therein will seal at four contact points, i.e., contact points E, F, G and H. When occluded together, closure element 70 and closure element 50 form an interlocked closure fastening device.

The closure fastening device of the instant invention may be made from a thermoplastic material selected from the group consisting of polyolefins such as polyethylene, polypropylene, and polybutylene; polyamides such as nylon; or other thermoplastic materials, including combinations thereof. The closure fastening device is preferably made from a thermoplastic resin composition comprising polypropylene, or a mixture of polypropylene resin and ethylene-propylene-diene monomer elastomer, or a mixture of polypropylene resin and ethylene-propylene copolymer elastomer. The dimensions of the closure fastening device may vary in accordance with intended use and depending upon the materials used in their manufacture because of the variations in physical properties, such as flexural moduli.

In the best mode, the closure fastening device of this invention is made from a poly(propylene-ethylene)-copolymer, or a resin blend selected from (a) a poly(-propylene-ethylene)copolymer and a polypropylene homopolymer, (b) a poly(propylene-ethylene)-copolymer and a polybutene copolymer, and (c) a poly(propylene-ethylene)copolymer and an elastomer. In addition, it is preferred that the closure elements comprise a poly(propylene-ethylene)copolymer containing between about 100 ppm and about 2000 ppm of a fatty acid amide slip agent, such as erucamide, based on the weight of the poly(propylene-ethylene)-copolymer. Suitable alternative compositions for the closure elements comprise a blend of (a) from about 85 to about 95 percent by weight of polypropylene homopolymer and from about 5 to about 15 percent by weight, preferably about 10 percent by weight, of a poly-1-butene copolymer containing up to about 5 percent by weight of ethylene; (b) from about 85 to about 95 percent by weight of polypropylene homopolymer and from about 5 to about 15 percent by weight, preferably about 10 percent by weight, of ethylene-propylene-diene monomer elastomer; (c) from about 85 to about 95 percent by weight of polypropylene homopolymer and from about 5 to about 15 percent by weight, preferably about 10 percent by weight, of ethylene-methyl acrylate copolymer; (d) from about 10 to about 50 percent by weight of polypropylene homopolymer and from about 50 to about 90 percent by weight, preferably about 70 percent by weight, of a poly(propylene-ethylene)-copolymer selected from the group of polypropylene copolymers having a melt flow rate of between about 1.5 and about 8, preferably about 7 grams/10 minutes as determined by ASTM test method D-1238, Condition "L", and a flexural modulus of between about 100,000 and about 132,000 psi or an MPA value of between about 690 and about 924 as determined by ASTM test method D-790; and (e) from about 85 to about 95 percent by weight of poly(propylene-ethylene)copolymer and from about 5 to about 15 percent by weight, preferably about 10 percent by weight, of a copolymer selected from the group consisting of (1) a poly-1-butene copolymer containing up to about 5 percent by weight of ethylene; (2) an ethylene-propylene-diene monomer elastomer; and (3) an ethylene-methyl acrylate copolymer. As in the best mode compositions employed to make the closure fastening devices herein, all of the alternative compositions preferably contain between about 100 ppm and about 2000 ppm of a fatty acid amide slip agent, such as erucamide, based on the weight of the blends.

The foregoing resin materials are all commercially available. For example, the poly(propylene-ethylene)-copolymer material may be obtained from Himont Inc., Wilmington, DE, under the tradename Pro-Fax ® SA-861; the polypropylene homopolymer may be obtained from Shell Chemical Company under the tradename Shell Polypropylene 5225; the poly-1-butene copolymer containing up to about 5 percent by weight of ethylene may be obtained from Shell Chemical Company under the tradename Shell Polybutylene 8640; the ethylene-propylene-diene monomer elastomer may be obtained from Uniroyal Chemical, Naugatuck, CT, under the tradename Royalene IM 7565 as a 65/35 weight blend of the elastomer high density polyethylene; the ethylene-methyl acrylate copolymer is available from Gulf Oil Chemicals Company under the tradename PE 2205; the poly(propylene-ethylene)copolymer may also be obtained from Cosden Oil Company under the tradenames Dypro W-431 and Dypro K-122, and from Himont Inc., Wilmington, DE, under the tradename Pro-Fax ® SA-752.

When the closure fastening device of this invention is connected to a container, it is preferred that the closure device be manufactured with flanges on each of the first and second closure elements as illustrated in FIG. 1 and FIG. 3 (elements 28 and 42) so that the flanges can be used to connect the closure elements to the container or to a film to be formed into a container. The flanges of the closure device may be made from a thermoplastic material selected from the group consisting of a polypropylene homopolymer, a poly-1-butene copolymer, an ethylene-propylene-diene monomer elastomer, an ethylene-methyl acrylate copolymer, and mixtures thereof. However, in the best mode of this invention, the flanges of the closure device are made from a blend of a polypropylene homopolymer and a poly-1-butene copolymer. More specifically, it is preferred that the flanges comprise from about 85 to about 95 percent by weight of polypropylene homopolymer and from about 5 to about 15 percent by weight of poly-1-butene copolymer containing up to about 5 percent by weight of ethylene. More preferably, the flanges comprise about 90 percent by weight of polypropylene homopolymer and about 10 percent by weight of poly-1-butene copolymer containing up to about 5 percent by weight of ethylene. Less preferred, but suitable, alternative material compositions for the flanges comprise (a) from about 85 to about 95 percent by weight of polypropylene homopolymer and from about 5 to about 15 percent by weight of ethylene-propylene-diene monomer elastomer; or (b) from about 85 to about 95 percent by weight of polypropylene homopolymer and from about 15 to about 15 percent by weight of ethylene-methyl acrylate copolymer, or (c) mixtures of (a) and (b).

The foregoing resin materials are commercially available. For example, the polypropylene homopolymer material may be obtained from Shell Chemical Company under the tradename Shell Polypropylene 5225; the poly-1-butene copolymer containing up to about 5 percent by weight of ethylene may be obtained from Shell Chemical Company under the tradename Shell Polybutylene 8640; the ethylene-propylene-diene monomer elastomer may be obtained from Uniroyal Chemical, Naugatuck, CT, under the tradename Royalene IM 7565 as a 65/35 weight blend of the elastomer/high density polyethylene; and the ethylene-methyl acrylate copolymer is available from Gulf Oil Chemicals Company under the tradename PE 2205.

It has been found that when the flange portions of the interlocking closure fastening device of this invention are made from the foregoing resin compositions, distortion of the closure elements is significantly reduced since the flange portions of the closure device experience minimal neck-in during extrusion. It has been found that the polypropylene homopolymer reduces neck-in of the flange portions during extrusion, and the presence of poly-1-butene reduces the flexural modulus of the polypropylene homopolymer making the device suitable for use after storage in a freezer. In preferred practice, the flanges and the closure elements are coextruded, however, the flanges and the closure elements may be extruded separately and then attached to each other by conventional means.

The closure fastening device of this invention can be manufactured by known methods such as by extrusion, by the use of molds or other known methods of producing such devices. The closure fastening device can be manufactured as a strip for later attachment to a film or it can be manufactured integral with the film. In addition, the closure device can be manufactured with or without flanges on one or both of the closure elements, depending upon intended use or expected additional manufacturing operations.

The closure elements can be connected with a container or to a film to be formed into a container by the use of many known methods. For example, a thermoelectric device can be applied to a film opposite a closure element to cause a transfer of heat through the film to produce melting at the interface of the film and the closure element. After cooling, the interface region joins the film and the closure element.

The thermoelectric device can be heated by rotary discs, or resistance heated wires, or traveling heater bands, or the like.

The connection between the film and the closure element can also be established by the use of hot melt adhesives, or heated jets of air to the interface, or ultrasonic heating, or other known methods.

Generally, the present closure fastening device can be made from a heat sealable material and then attached to a heat sealable film so that a container can be formed economically by heat sealing surfaces to form the container.

The instant closure fastening device provides many advantages for consumers when used on containers. For instance, it is easy to close a container because the closure elements rotate or twist with respect to each other from the de-occluded to the occluded position with little effort in spite of the high flexural moduli of the temperature resistant resins used. The action contrasts with prior art structures such as arrow type of closures where, in the female elements, the hooked sides have to be bent or otherwise distorted for occlusion or de-occlusion. In a prior art channel closure, a base portion has to be bent to accomplish occlusion or de-occlusion. And still another structure made very stiff, requires longitudinal displacement to a non-hooked end before the first or male and second or female closure elements can be pried apart by elastic bending of portions of each element.

Moreover, the closure fastening device of this invention provides, in combination, novel functions and structures wherein the closure device is easy to occlude and de-occlude even though it is made from high modulus; i.e., stiff, resins; it is resistant to high and low temperature conditions; it has a "preferential opening" characteristic whereby the closure device is easily opened from the outside of a container, but strongly resists opening from the inside of a container; it is completely drip-proof and leak-proof when partially filled with a liquid such as water; and it is completely drip-proof and leak-proof when fully filled with a liquid such as water.

Generally, the closure device of the invention can be manufactured in a variety of forms to suit the intended use. In addition to the embodiments shown herein, the elements can be positioned on opposite sides of a film. Such an embodiment would be suited for enwrapping an object or a collection of objects such as wires. Generally, the elements on a film should be parallel to each other but this would depend on the intended use.

Although certain embodiments of the present invention have been described and set forth in detail, it should be further understood that other embodiments of the invention are contemplated by way of changes, modifications and variations to the description without departing from the scope and spirit of the invention as set forth in the appended claims. Such changes, modifications and variations are within the scope of this invention.

What is claimed is:

1. A closure fastening device comprising a first closure element and a second closure element; said first closure element having a general omega shape, comprising an apex portion and a profile portion extending from said apex portion, said profile portion comprising a first arm portion and a second arm portion spaced apart from each other, said first arm portion and said second arm portion extending from said apex portion in a direction generally perpendicular therefrom, said first arm portion and said second arm portion each having a middle portion which extends generally laterally inwardly, and said first arm portion and said second arm portion each having a top portion which extends generally laterally outwardly before terminating in an outwardly, laterally extending, curving hook portion; said second closure element having a general trident shape, comprising an apex portion and a profile portion extending in a generally perpendicular direction from said apex portion, said profile portion comprising a first arm portion, a second arm portion, and a third arm portion, said first arm portion, said second arm portion, and said third arm portion being generally parallel to and spaced apart from each other, said first arm portion comprising a base portion extending perpendicularly from said apex portion, a generally straight middle portion extending from said base portion to a top portion, the top portion including a hook portion wherein said hook portion terminates in an outwardly extending hook projection portion and in an inwardly extending hook projection portion which is smaller than said outwardly extending hook projection portion; said second arm portion comprising a generally straight structure extending perpendicularly from said apex portion and having a length shorter than said first arm portion and said third arm portion, said second arm portion having a generally rounded, enlarged configuration at its extremity, said third arm portion comprising a base portion extending perpendicularly from said apex portion, a generally straight middle portion extending from said base portion to a top portion, the top portion including a hook portion wherein said hook portion terminates in an outwardly extending hook projection portion and in an inwardly extending hook projection portion which is smaller than said outwardly extending hook projection portion; said first closure element and said second closure element forming an interlocked closure fastening device when they are occluded together.

2. A container comprising two sidewalls and a closure fastening device, said closure fastening device comprising a first closure element and a second closure element; said first closure element having a general omega shape, comprising an apex portion and a profile portion extending from said apex portion, said profile portion comprising a first arm portion and a second arm portion spaced apart from each other, said first arm portion and said second arm portion extending from said apex portion in a direction generally perpendicular therefrom, said first arm portion and said second arm portion each having a middle portion which extends generally laterally inwardly, and said first arm portion and said second arm portion each having a top portion which extends generally laterally outwardly before terminating in an outwardly, laterally extending, curving hook portion; said second closure element having a general trident shape, comprising an apex portion and a profile portion extending in a generally perpendicular direction from said apex portion, said profile portion comprising a first arm portion, a second arm portion, and a third arm portion, said first arm portion, said second arm portion, and said third arm portion being generally parallel to and spaced apart from each other, said first arm portion comprising a base portion extending perpendicularly from said apex portion, a generally straight middle portion extending from said base portion to a top portion, the top portion including a hook portion wherein said hook portion terminates in an outwardly extending hook projection portion and in an inwardly extending hook projection portion which is smaller than said outwardly extending hook projection portion; said second arm portion comprising a generally straight structure extending perpendicularly from said apex portion and having a length shorter than said first arm portion and said third arm portion, said second arm portion having a generally rounded, enlarged configuration at its extremity, said third arm portion comprising a base portion extending perpendicularly from said apex portion, a generally straight middle portion extending from said base portion to a top portion, the top portion including a hook portion wherein said hook portion terminates in an outwardly extending hook projection portion and in an inwardly extending hook projection portion which is smaller than said outwardly extending hook projection portion; said first closure element and said second closure element forming an interlocked closure fastening device when they are occluded together.

* * * * *

UNITED STATES PATENT AND TRADEMARK OFFICE

CERTIFICATE OF CORRECTION

PATENT NO. : 4,778,282

DATED : October 18, 1988

INVENTOR(S) : Michael G. Borchardt, et al.

It is certified that error appears in the above-identified patent and that said Letters Patent is hereby corrected as shown below:

Column 4, line 29: Replace the word "ditted" with the word --dotted--.

Column 4, line 34: Replace the number "20" with the number --23--.

Column 5, line 19: Replace the number "10" with the word --to--.

Column 10, line 50: Replace the number "63" with the number --62--.

Column 13, line 9: Delete the first occurrence of "15" and replace with the number --5--.

Signed and Sealed this

Sixteenth Day of April, 1991

*Attest:*

HARRY F. MANBECK, JR.

*Attesting Officer*

*Commissioner of Patents and Trademarks*